US006895202B2

(12) United States Patent
LeStrange et al.

(10) Patent No.: US 6,895,202 B2
(45) Date of Patent: May 17, 2005

(54) NON-INTERACTIVE DEVELOPMENT APPARATUS FOR ELECTROPHOTOGRAPHIC MACHINES HAVING ELECTRODED DONOR MEMBER AND AC BIASED ELECTRODE

(75) Inventors: Jack T. LeStrange, Macedon, NY (US); Dan A. Hays, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 73 days.

(21) Appl. No.: 10/666,880

(22) Filed: Sep. 19, 2003

(65) Prior Publication Data

US 2005/0063737 A1 Mar. 24, 2005

(51) Int. Cl.[7] ..... G03G 15/08
(52) U.S. Cl. ..... 399/266; 399/290; 399/291
(58) Field of Search ..... 399/252, 265, 399/266, 267, 290, 291

(56) References Cited

U.S. PATENT DOCUMENTS 4,618,241 A * 10/1986 Hays et al. ..... 399/284
4,868,600 A 9/1989 Hays et al.
5,276,488 A 1/1994 Schmidlin
5,278,020 A 1/1994 Grushkin et al.
5,290,654 A 3/1994 Sacripante et al.
5,300,339 A 4/1994 Hays et al.
5,305,070 A * 4/1994 Snelling ..... 399/232
5,308,734 A 5/1994 Sacripante et al.
5,344,738 A 9/1994 Kmiecik-Lawrynowicz et al.
5,346,797 A 9/1994 Kmiecik-Lawrynowicz et al.
5,360,940 A * 11/1994 Hays ..... 399/266
5,364,729 A 11/1994 Kmiecik-Lawrynowicz et al.
5,366,841 A 11/1994 Patel et al.
5,370,963 A 12/1994 Patel et al.
5,386,277 A 1/1995 Hays et al.
5,403,693 A 4/1995 Patel et al.
5,418,108 A 5/1995 Kmiecik-Lawrynowicz et al.
5,491,538 A * 2/1996 Gwaltney ..... 399/223
5,504,563 A 4/1996 Hays

* cited by examiner

*Primary Examiner*—Hoan Tran
(74) *Attorney, Agent, or Firm*—Robert Chittum

(57) ABSTRACT

A non-interactive development system generates a toner cloud in a development zone by an AC biased stationary electrode positioned in contact with the back surface of a movable toned dielectric donor belt having a patterned electrode structure on the front surface thereof. The AC biased electrode produces AC fringe fields near the edges of the patterned electrode structure that cause the generation of a toner cloud for developing an electrostatic latent image. The donor belt is partially wrapped around a magnetic brush to produce a toner loading zone. Isolated patterned electrodes on the donor belt near the entrance region of the toner loading zone are biased to cause unloading of toner from the donor belt, while isolated electrodes near the exit region of the toner loading zone are biased to cause toner reloading of the donor belt.

11 Claims, 6 Drawing Sheets

NON-INTERACTIVE DEVELOPMENT APPARATUS FOR ELECTROPHOTOGRAPHIC MACHINES HAVING ELECTRODED DONOR MEMBER AND AC BIASED ELECTRODE

BACKGROUND OF THE INVENTION

An exemplary embodiment of this application relates to a multicolor development system for an electrophotographic reproducing machine. More particularly, the exemplary embodiment relates to a multicolor development system having a plurality of non-interactive development apparatus, each of which generate a respective toner cloud adjacent the machine's photoreceptor as the photoreceptor is moved past each of the development apparatuses. The toner clouds develop and render visible successive portions of a multicolor latent electrostatic image on the photoreceptor with substantially no scavenging or redevelopment of a first developed image portion.

One type of electrophotographic reproducing machine is a xerographic copier or printer. In a typical xerographic copier or printer, a photoreceptor surface is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is prepared to be used once again for the reproduction of a copy of an original. The paper with the powdered toner thereon in imagewise configuration is separated from the photoreceptor and moved through a fuser to permanently fix or fuse the toner image to the paper.

Development of full color or multicolor electrostatic latent images requires non-interactive development systems to prevent the disturbance and contamination of previously developed image portions. Generally, full color electrostatic latent images are generally composed of a set of scanned images serially superimposed on top of each other. Each of the scanned images represent one color of the multicolor original document, and hence such multicolor latent image is often referred to as image-on-image. Usually the magenta image portion of the latent image is developed first, followed by a yellow portion, then cyan, and finally black. Clearly, the first developed image must not be disturbed by the subsequently developed image nor must there be cross contamination of the toner images.

The type of development systems which do not disturb or cross contaminate the images as they are separately developed are referred to as non-interactive development devices and primarily relate to various powder cloud development systems. There are a number of well known non-interactive development systems, such as, for example, the scavengeless development devices as disclosed in U.S. Pat. Nos. 4,868,600 and 5,504,563. However, as the speed of the reproducing machines increase and the resolution of the images increase, the short comings of the existing non-interactive development devices become more pronounced. Some scavengeless development systems required stationary wire electrodes located in the toner clouds that become contaminated with toner, additives and other debris, while others types require expensive interdigitated electrodes on donor rolls addressed by a robust commutator.

Toner development systems normally fall into two catagories; viz., those that use carrier beads or granules and toner particles and those that use only toner particles for the developer material. The carrier beads are usually magnetic and the toner particles are usually nonmagnetic, but triboelectrically adhere to the carrier beads. The toner particles are attracted to the electrostatic latent image and form a toner particle image on the photoreceptor surface. As indicated above, the toner particle image is transferred from the surface of the photoreceptor to a recording medium, such as paper, and then the toner particle image is heated to fuse it permanently to the recording medium in image configuration.

Triboelectric charging of the toner particles is obtained by mixing the toner particles with the larger carrier beads in a two component developer material or by rubbing the toner particles between a doctor blade and a donor member in a single component developer material. Magnetic brush development systems generally have a sleeve that axially rotates with fixed internal magnets that attract magnetic carrier beads thereto from a sump and transport them to a development zone adjacent the movable photoreceptor. Nonmagnetic particles of toner are triboelectrically attracted to the carrier beads, and as the toner particles, hereafter called toner, enters the development zone, the toner is attracted from the carrier beads to the electrostatic latent image on the confronting surface of the photoreceptor. Jumping development systems attract toner from a sump onto an axially rotated donor roll which rotates the toner to a location spaced from but adjacent a electrostatic latent image on a moving photoreceptor. The toner is attracted from the donor roll to the electrostatic latent image and jumped across the space or gap to render the electrostatic latent image visible. Such commercial development systems as magnetic brush or jumping single component development systems interact with the photoreceptor and a previously toned image will be scavenged by subsequent development.

There are many existing scavengeless development systems that prevent interaction of the development system with the previously developed image. For example, U.S. Pat. No. 4,868,600 discloses a scavengeless development system in which toner detachment from a donor roll and the concomitant generation of a toner cloud is obtained by AC electric fields supplied by spaced wire electrodes positioned in close proximity to the donor roll and within the space between the donor roll and the photoreceptor surface containing the electrostatic latent image. However, the wire electrodes are subject to contamination by toner and other debris that impacts the performance of the wire electrodes.

U.S. Pat. No. 5,276,488 discloses a scavengeless development system in which toner is detached from a donor belt and attracted to an electrostatic latent image carried by a moving photoreceptor positioned adjacent the belt. Generation of a toner cloud is effected using AC electric fields created by applying an AC voltage to an embedded interdigitated electrode structure in a shoe stationarily positioned behind the donor belt. One disadvantage of such a configuration is that the electric field at the toner layer on the donor belt is reduced by the thickness of the belt, so mechanically robust belts cannot be used. Furthermore, if interdigitated electrodes are used in the shoe, the dielectric polarization of the belt material will tend to shunt the electric field from the AC biased electrodes, and the electric field falls off exponentially with increasing belt thickness and decreasing spacing between the electrodes.

U.S. Pat. No. 5,504,563 discloses a scavengeless or non-interactive development system in which an AC bias is applied between neighboring interdigitated electrodes embedded in a rotating donor roll or belt. In addition to requiring high manufacturing tolerances, such interdigitated electrodes require a robust commutator device for supplying a high AC voltage thereto, so that the manufacturing costs are high.

SUMMARY OF THE INVENTION

It is an object of an exemplary embodiment of this application to provide a non-interactive development system for an electrophotographic reproducing machine that enables image-on-image, full color printing by generating a toner cloud in the development zone with an AC voltage applied to a fixed electrode positioned behind a toned moving dielectric donor belt having an electrode structure patterned on the front surface thereof.

In one aspect of the exemplary embodiment, there is provided a non-interactive development apparatus for each color of toner to be used in a multicolor electrophotographic machine having a moving photoreceptor therein, each development apparatus being capable of developing a successive portion of a multicolor electrostatic latent image on a surface of said photoreceptor with toner without disturbance or contamination of previously developed portions of the electrostatic latent image, said development apparatus comprising: a housing defining a chamber storing a supply of developer material comprised of carrier and toner; a movable donor belt having a front and back surface with an electrode pattern being formed on said belt front surface, said belt being adjacent but spaced from the photoreceptor surface for conveying toner on said front belt surface to a development zone located in a space between said donor belt and photoreceptor surface; means for supporting said donor belt for movement in an endless path past the development zone; means for advancing developer material from the housing chamber, said advancing means and said donor belt cooperating with one another to deposit a substantially constant quantity of toner having a substantially constant triboelectric charge onto said donor belt front surface for transporting said toner through said development zone; a stationary electrode positioned behind and in contact with the back surface of a span of said donor belt, said stationary electrode having a dimension and location to define said development zone; and an AC voltage supply connected to the stationary electrode to provide an AC bias thereto, the AC voltage producing AC fringe fields at the edges of the electrode pattern on said front surface of the donor belt as said donor belt is conveyed past the stationary electrode, whereby said AC fringe fields cause detachment of the toner from the donor belt front surface and generation of a toner cloud in the development zone that develops the electrostatic latent image on the photoreceptor surface.

BRIEF DESCRIPTION OF THE DRAWINGS

An exemplary embodiment of this application will now be described, by way of example, with reference to the accompanying drawings, in which like reference numerals refer to like elements, and in which.

DESCRIPTION OF THE PREFERRED EMBODIMENT

Figure 1:
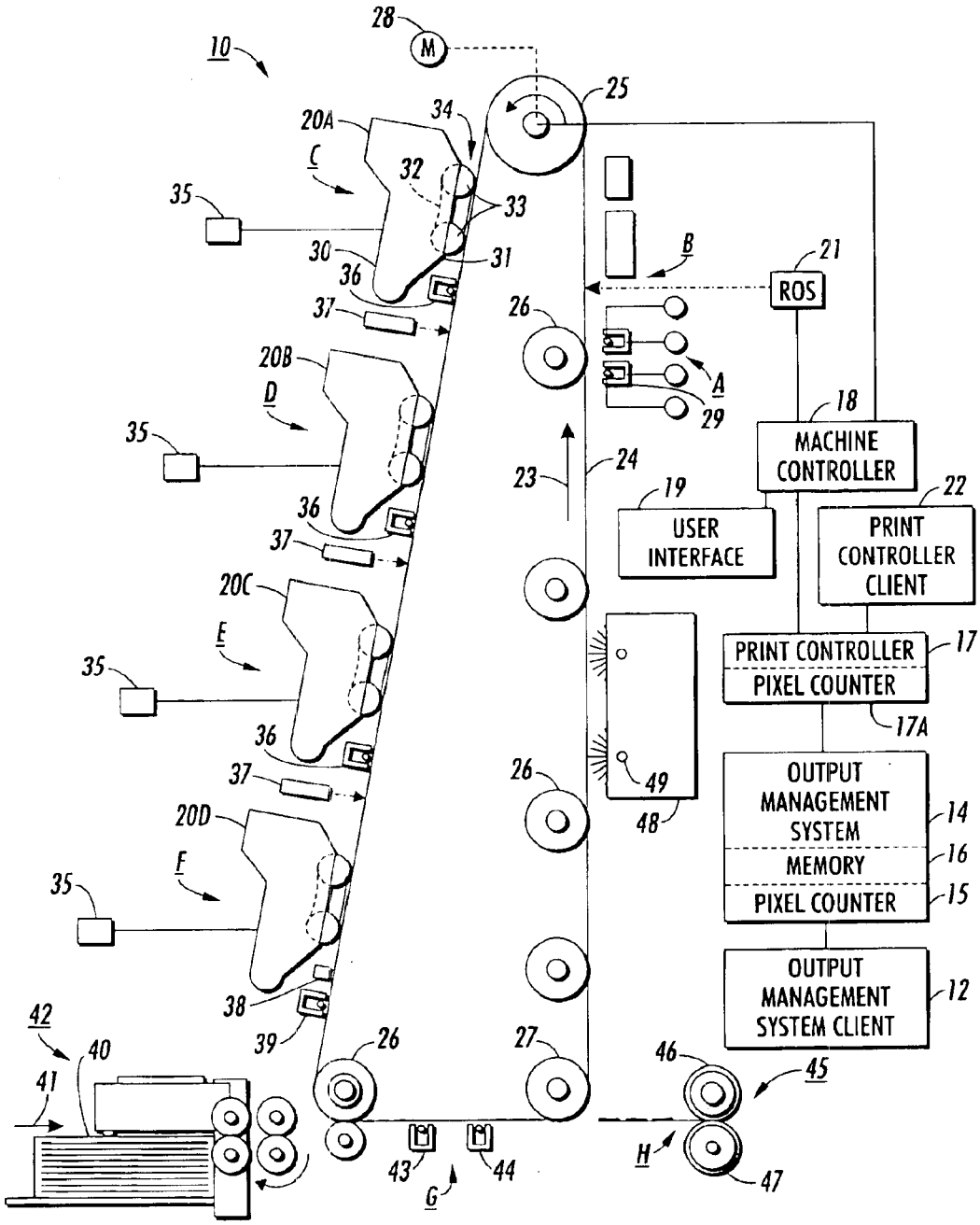
FIG. 1 is a schematic elevation view of an illustrative electrophotographic machine incorporating a plurality of the development apparatus of this application.

FIG. 1 schematically depicts the various components of an illustrative multicolor electrophotographic reproducing machine 10, incorporating a plurality of the development apparatuses 20A–20D, each of which are exemplary embodiments of this application. Inasmuch as the art of electrophotographic printing is well known, the operation of the machine 10 shown in FIG. 1 and the xerographic processing stations employed therein will be only briefly described.

Printing jobs may be initiated by an operator at the User Interface 19 on the machine's control panel (not shown), whereby the operator's instructions are entered into the Machine Controller 18. Printing jobs may be submitted from the Output Management System Client 12 to the Output Management System 14. A pixel counter 15 is incorporated into the Output Management System to count the number of pixels to be imaged with toner on each sheet or page of the job for each color. The pixel count information is stored in the memory 16 of the Output Management System. The Output Management System 14 submits job control information, including the pixel count data, and the printing job to the Print Controller 17. Job control information, including the pixel count data, and digital image data from the Print Controller Client 22 are communicated from the Print Controller 17 to the Machine Controller 18. In this embodiment, pixel counting by a Pixel Counter 17A in the Print Controller 17 is not necessary since the data has been provided with the job control information from the Output Management System 14.

The electrophotographic machine 10 preferably uses an active matrix (AMAT) photoreceptor belt 24, supported for movement in the direction indicated by arrow 23, that is advanced sequentially through the various xerographic process stations. The belt 24 is entrained about a drive roller 25, tension rollers 26, and fixed roller 27. The drive roller 25 is operatively connected to a drive motor 28 for effecting movement of the belt 24 through the xerographic stations. A portion of belt 24 passes through charging station A where a pair of corona generating devices 29 charges the photoconductive surface of the photoreceptor belt 24 to a relatively high and substantially uniform potential that in the preferred embodiment is negative.

Next, the charged portion of the belt 24 is advanced through an imaging station B. The Machine Controller 18 receives the image signals from Print Controller 17 that represent the desired output image and processes these signals to convert them to signals transmitted to a laser based raster output scanning device (ROS) 21. The ROS 21 causes the charged surface of the photoreceptor to be discharged in accordance with the output of the ROS. Alternatively, the ROS could be replaced with other exposure devices, such as LED arrays.

The photoreceptor belt 24 is initially charged to a voltage $V_0$ that undergoes a dark decay to a level equal to about −500 volts. When exposed at the exposure station B, the voltage V0 charge is discharged to a level equal to about −50 volts. Thus, after exposure, the photoreceptor belt 24 contains a voltage profile of high and low voltages, the former corresponding to charged or background areas and the latter corresponding to discharged or images areas.

At a first development station C, developer apparatus 20A uses the non-interactive development system which is an exemplary embodiment of this application, as discussed later. Developer apparatus 20A has a housing 30 with a supply of two component developer material (not shown in FIG. 1) and an opening 31 through which a donor belt 32 extends that is mounted for rotation about rollers 33. As explained later, the donor belt is supplied with two types of development electric fields. One electric field is an AC field which is used for generating a toner cloud in the gap 34, and a second electric field is a DC development field which is used to control the amount of developed toner mass on the electrostatic latent image on the photoreceptor belt 24. The toner cloud causes charged toner to be attracted to the electrostatic latent image. Appropriate developer material biasing is accomplished by a power supply (not shown). The donor belt conveys toner extracted from the developer material to a gap 34 between the donor belt and the photoreceptor belt for development via a generated toner cloud of the electrostatic latent images on the photoreceptor. For multicolor or full color electrostatic latent image development, the latent image is developed by successively applying different color toner. The non-interactive development system is a non-contact type of development and, at station C, uses only magenta toner to develop the electrostatic latent image on the photoreceptor. A toner concentration sensor 35 senses the toner concentration in the housing 30.

The developed but unfixed image is then transported past a second charging device 36, where the photoreceptor belt 24 and previously developed magenta toner image areas are recharged to a predetermined level. A second imaging is performed by a laser based output device 37 that is used to selectively discharge the photoreceptor belt 24 on both magenta toner areas and untoned areas, forming a second latent electrostatic image pursuant to the next color image to be developed with the second color toner. The colored or non-black toners do not strongly absorb light in the infrared part of the electromagnetic spectrum. In the preferred embodiment the second color of toner is yellow.

At this point, the photoreceptor belt 24 contains both magenta toned and untoned areas at relatively high voltage levels and magenta toned and untoned areas at relatively low voltage levels. These low voltage areas represent image areas that are to be developed using discharged areas development (DAD). To this end, a negatively charged yellow toner is employed. The developer material includes yellow toner and is contained in a developer apparatus 20B disposed at a second developer station D. Developer apparatus 20B is similar to the first developer apparatus 20A and, therefore, has like components. The donor belt of the developer apparatus 20B conveys yellow toner extracted from the developer material to a gap 34 between the donor belt and photoreceptor for DAD development of the second latent electrostatic image. Thus, the yellow toner is presented to the second latent electrostatic image on the photoreceptor belt produced by the second imaging output device 37 by way of the second developer apparatus 20B and a toner cloud of yellow toner generated thereby. A power supply (not shown) serves to electrically bias the developer apparatus 20B to a level effective to develop the discharged image areas with the negatively charged yellow toner. Again, a toner concentration sensor 35 senses the yellow toner concentration in the developer apparatus 20B.

A procedure similar to that described above is repeated for development of a third latent electrostatic image by a third suitable toner color, such as cyan, at developer station E via development apparatus 20C. Finally, a similar procedure is repeated for development of a fourth latent electrostatic image by a fourth suitable color toner, such as black, at developer station F via development apparatus 20D. In this manner, a full color composite toner image is developed on the photoreceptor belt 24. In addition, a mass sensor 38 measures developed mass per unit area. Although only one mass sensor 38 is shown in FIG. 1, there may be more than one mass sensor used.

To the extent to which some toner charge is totally neutralized or the polarity reversed, thereby causing the composite image developed on the photoreceptor belt 24 to consist of both positive and negative toner, a negative pre-transfer dicorotron device 39 is provided to condition the toner for effective transfer to a recording medium, such as paper, using positive corona discharge.

Subsequent to image development, a sheet of recording medium, such as paper 40, is moved into contact with the multicolor composite toner images at the transfer station G. The sheet of paper 40 is advanced to transfer station G by a sheet feeding apparatus 42, described below. The sheet of paper 40 is then brought into contact with the surface of the photoreceptor belt having the developed images in a timed sequence, so that the composite toner image developed thereon contacts the advancing sheet of paper 40 at transfer station G.

Transfer station G includes a transfer dicorotron 43 that sprays positive ions onto the backside of sheet 40. This attracts the negatively charged toner images from the photoreceptor belt 24 to sheet 40. A detack dicorotron 44 is provided for facilitating stripping of sheets 40 from the photoreceptor belt 24.

After transfer, the sheet of paper 40 continues to move, in the direction of arrow 41, onto a conveyor (not shown) that advances the paper sheet to fusing station H. Fusing station H includes a fuser assembly 45 that permanently affixes the transferred combined toner images to sheet of paper 40. Preferably, fuser assembly 45 comprises a heated fuser roller 46 and a pressure roller 47. The sheet of paper containing the toner images passes between fuser roller 46 and pressure roller 47 with the toner images contacting the fuser roller. In this manner, the combined toner images are permanently fused to the sheet of paper. After fusing, a chute (not shown) guides the advancing sheets 40 to a catch tray, finisher or other output device (not shown) for subsequent removal from the electrophotographic machine by the operator.

After the sheet of paper 40 is separated from the surface of the photoreceptor belt 24, the toner not transferred to the paper, referred to residual toner, is removed therefrom. The residual toner is removed at cleaning station 1 using a one or more cleaning brushes 49 contained in an enclosure 48.

Machine controller 18 regulates the various electrophotographic machine functions. The machine controller 18 is preferably a programmable controller that controls the machine functions hereinbefore described. The machine controller 18 may provide a comparison count of the sheets of paper used, the number of documents being recirculated, the number of sheets of paper selected by the operator, time delays, jam corrections, etc. The control of all of the exemplary systems heretofore described may be accomplished by conventional control switch inputs from the User Interface 19 of the electrophotographic machine as selected by an operator.

It is believed that the foregoing description is sufficient for purposes of the present application to illustrate the general operation of an electrophotographic machine incorporating an exemplary embodiment of the non-interactive development apparatus of this application.

Figure 2:
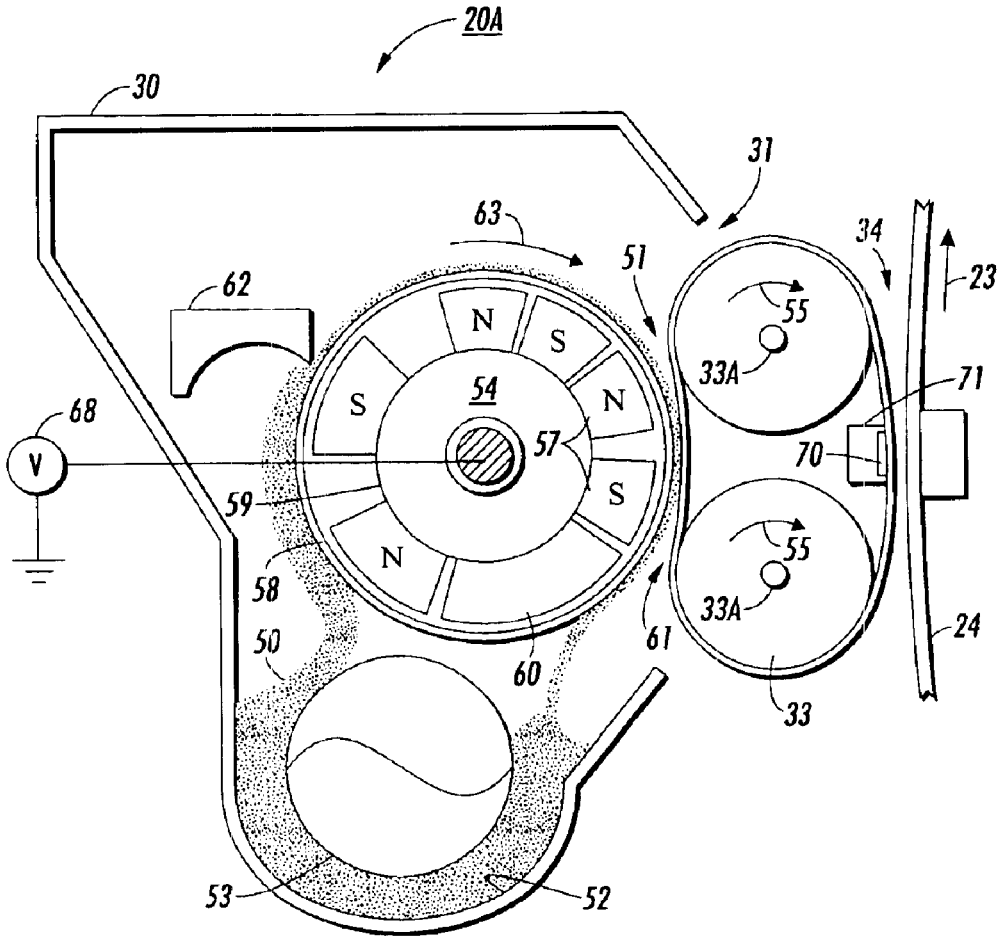
FIG. 2 is a schematic elevation view of one of the development apparatus of this application shown in cross-section.

In FIG. 2, an enlarged schematic elevation view of one of the substantially similar development apparatus of this application is shown in cross-section. The details of the development apparatus 20A, shown in FIG. 2, is representative of the other three of the development apparatuses 20B, 20C, 20D shown in FIG. 1. The development apparatus 20A comprises a housing 30 containing a supply of developer material 50 in a lower section or sump 52 of the housing. The developer material 50 is of the two component type; i.e., it comprises carrier beads and powdered toner. The housing sump 52 includes at least one auger 53 that is rotatably mounted therein and rotated by any suitable drive means, such as, for example, an electric motor (not shown). The auger serves to disperse and mix the toner with the carrier beads, to transport the developer material to appropriate locations within the sump 52, and to agitate the developer material within the sump to triboelectrically charge the toner so that the toner adheres to the carrier beads.

Figure 4:
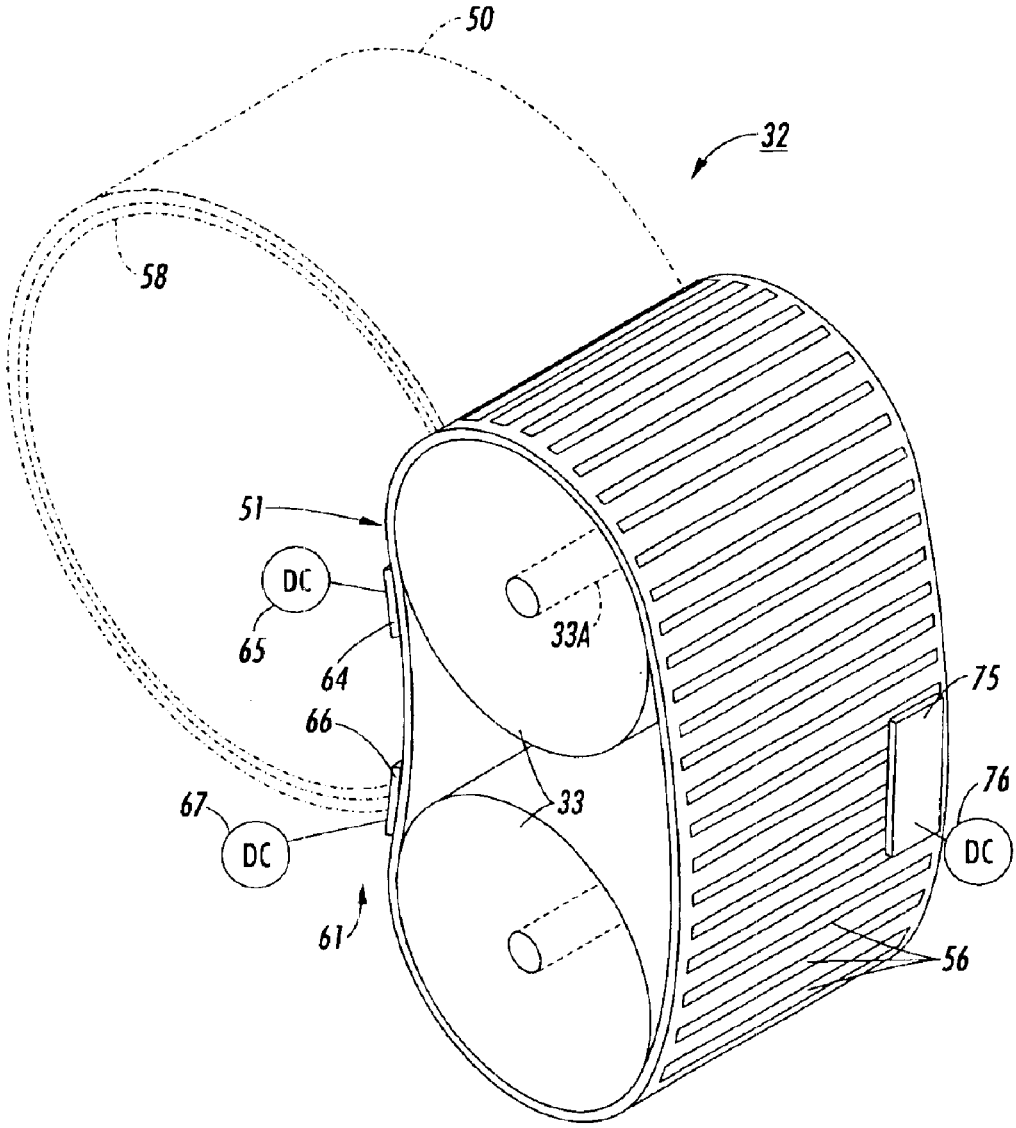
FIG. 4 is an isometric view of the donor belt of the development apparatus of FIG. 2 showing the electrode pattern on the surface thereof.

A magnetic brush roll 54 transports developer material 50 from the sump 52 to the loading nip 51 of the donor belt 32. The donor belt is mounted for rotation about two parallel rollers 33, at least one of which is rotatably driven in the direction of arrow 55 about its axis 33A. The driven donor belt roller 33 may be rotated by any suitable means, such as an electric motor (not shown). As shown in FIG. 4, the donor belt 32 has a pattern of parallel elongated electrodes 56 on the front or outer surface thereof that are parallel to the axes 33A of the donor belt rollers 33. With continued reference to FIG. 2, the donor belt is partially wrapped around a segment of the magnetic brush roll 54, to provide a loading and unloading zone for the donor belt that is about 2 cm long. A layer of developer material 50 is sandwiched between the magnetic brush roll and the donor belt where the donor belt is partially wrapped around the magnetic brush roll. The span of donor belt between the donor belt rollers 33 that is opposite the span adjacent and wrapped around the magnetic brush roll 54 is spaced from and confronts the photoreceptor belt 24, forming a gap 34 therebetween. This gap is the development zone, where a toner cloud will be produced, as explained later, to develop the latent electrostatic image on the surface of the photoreceptor belt 24.

Magnetic brushes are well known, so the construction of magnetic brush roll 54 need not be described in great detail. Briefly, the magnetic brush roll comprises a rotatable tubular member 58 within which is located a stationary magnetic cylinder 59 having a plurality of alternately polarized magnetic pole pieces 57 impressed around its outer surface. A non-magnetic member 60 is impressed among the magnetic poles on the magnetic cylinder 59 at a location downstream from the unloading nip 61 in order to remove the developer material 50 from the magnet brush roll. The carrier beads of the developer material 50 are magnetic and, as the tubular member 58 of the magnetic brush roll 54 rotates in a direction of arrow 63, the carrier beads, together with the toner adhering triboelectrically thereto, are attracted to the magnetic brush roll, except in a region adjacent the non-magnetic member 60. Thus, the developer material is conveyed to the donor belt through loading nip 51, between the magnetic brush roll and donor belt, and to the unloading nip 61, where the non-magnetic member 60 subsequently causes the developer material to drop from the magnetic brush roll and into the sump 52.

A metering blade 62 removes excess developer material 50 from the magnetic brush roll 54 and ensures an even depth of coverage with developer material before arrival at the loading nip 51. The donor belt 32 is wider than both the photoreceptor belt 24 and the magnetic brush 54. The donor belt has edge portions extending for equal distances beyond each side of the photoreceptor belt and each side of the magnetic brush. The edge portions of the donor belt extend beyond the photoreceptor belt and the magnetic brush in order to accommodate each of the commutator brushes 64, 66, and 75, as shown in FIG. 4. At donor belt loading nip 51, a commutator brush 64 is located at the outer edge of the donor belt and electrically biases several of the adjacent donor belt electrodes 56 and loads or effects deposition of the triboelectrically charged toner onto the donor belt 32. When negatively charged toner is utilized, a positive DC voltage in the range of 500 to 3,000 volts provided by a DC voltage source 65 is applied to the commutator brush 64. The bias level controls the amount of toner deposition on the donor belt. The DC voltage on the electrodes 56 applied by the commutator brush also provides an electric field between the biased electrodes and the magnetic brush roll 54 that is usually held at a different DC potential of about 100 volts by voltage source 68 (FIG. 2).

Similarly, a commutator brush 66 is located on the outer edge of the donor belt at the donor belt unloading nip 61 to electrically bias several adjacent donor belt electrodes 56 to effect unloading of the toner therefrom. A negative DC voltage in the range of 500 to 3,000 volts is applied to the commutator brush 66 from DC voltage source 67.

Optionally, a voltage difference may be applied between the donor belt electrodes 56 and conductive donor belt rollers 33 to create fringe fields near the edges of the biased donor belt electrodes in the vicinity of the loading nip 51 and unloading nip 61. The relative amounts of toner transferred from the magnetic brush roll 54 to the donor belt 32 can be adjusted, for example, by applying different bias voltages to the donor belt electrodes 56, adjusting the spacing between the magnetic brush roll and the donor belt, adjusting the strength and shape of the magnetic field at the loading nips 51, and/or adjusting the speeds of the donor belts at each of the developer apparatuses. Different electric field configurations may be obtained to enable performance optimization and broader developer material latitudes.

The donor belt 32 transports the toner to the development zone in gap 34 where a toner cloud is produced, as explained later, for effecting non-interactive development of the electrostatic latent image on the surface of the photoreceptor belt 24 as it passes the development zone. As the donor belt enters unloading nip 61, a commutator brush 66 (see FIG. 4) located at the outer edge of the donor belt electrically biases several of the donor belt electrodes 56. When negatively charged toner is utilized, a negative DC voltage in the range of 500 to 3,000 volts provided by a DC voltage source 67 is applied to commutator brush 66. The biasing of the donor belt electrodes by the commutator brush 66 effects unloading of the triboelectrically charged toner from the donor belt onto the magnetic brush roll 54.

The development apparatus of this application continually unloads and reloads toner onto the electroded donor belt 32 with a single magnetic brush roll 54 using two-component developer material 50 that enables a stable toner layer with use of either conductive or insulative developer material. The exemplary embodiment shown in FIG. 2 enables continual toner layer unloading and reloading to circumvent image defects known as ghosting and toner aging problems caused by toner having long residence time on the donor belt. Because the toner on the donor belt can undergo size and adhesion changes induced by residence time of toner on the donor belt, continual unloading of toner for each revolution or cycle of the donor belt is preferred.

As the tubular member 58 of the magnetic brush roll 54 rotates beyond the unloading nip 61, non-magnetic member 60 causes the developer material, including the toner retrieved from the donor belt, to be removed from the magnetic brush roll and delivered to the sump 52. As successive latent electrostatic images are developed, the toner within the developer material 50 is depleted. A toner dispenser (not shown) stores a supply of toner and is in communication with the sump 52. When the toner concentration sensor 35 senses a low level of toner in the developer material, a signal is sent to the Machine Controller 18 which causes fresh toner to be dispensed from the toner dispenser into the sump to increase the toner concentration in the developer material. The auger 53 in the sump 52 mixes the fresh toner with the developer material in the sump, so that the resultant developer material is substantially uniform with the desired concentration of toner. In this way, a substantially constant amount of toner is maintained in the sump. Though the direction of movement of the photoreceptor belt 24, as indicated by arrow 23, is against or in the opposite direction to the movement of donor belt 32, as indicted by arrows 55, they may move in the same direction.

The two-component developer material 50 used in the developer apparatus shown in FIG. 2 has a preferred toner that is prepared by the emulsion/aggregation/coalescing toner processes illustrated in a number of Xerox patents, the disclosures of which are totally incorporated herein by reference, such as U.S. Pat. Nos. 5,290,654; 5,278,020; 5,308,734; 5,370,963; 5,344,738; 5,403,693; 5,418,108; 5,364,729; 5,346,797; and 5,366,841. The components and processes from these Xerox patents can be selected for the preparation of the toner preferably used in the exemplary embodiment of this application. The toner prepared by such components and processes produces a very narrow particle size distribution which improves image quality by providing increased edge sharpness, cleaner backgrounds, broader color gamut, and more uniform image quality.

Figure 3:
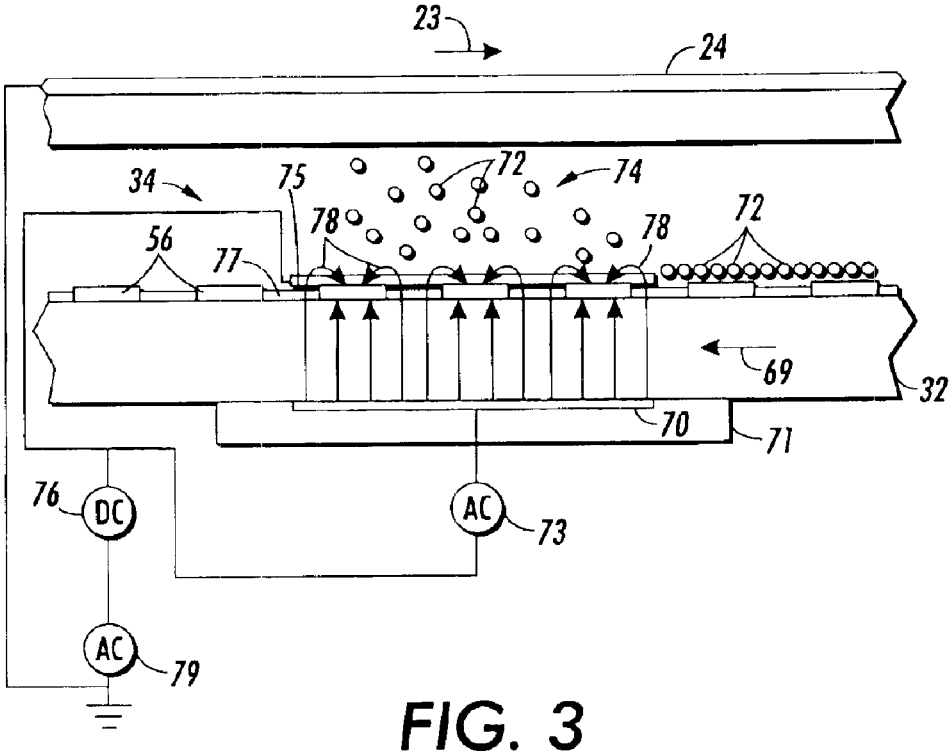
FIG. 3 is a schematic cross-section of a portion of the development apparatus of FIG. 2 showing the concept and key elements of an exemplary embodiment of this application.

FIG. 3 is a schematic cross-sectional view of a portion of the development apparatus 20A shown in FIG. 2 and illustrates the concept and key elements of an exemplary embodiment thereof. A portion of the span of donor belt 32 is shown moving in the direction of arrow 69 over the stationary AC biased electrode 70 that is formed on a stationary dielectric support structure 71. A pattern of elongated parallel electrodes 56 is formed on the front surface of the donor belt that is opposite to the donor belt back surface that is in moving contact with the stationary electrode 70. The donor belt surface having the patterned electrodes on the front surface is spaced from the moving photoreceptor 24 that is moving in the direction of arrow 23 and forms gap 34. The spacing between the donor belt 32 and electrostatic latent image on the photoreceptor surface is typically in the range of 100 to 500 $\mu$m, and preferably around 300 $\mu$m. Triboelectrically charged toner 72 enters the gap 34 on the moving donor belt surface having the patterned electrodes 56. The development zone is defined by the width and length of the stationary electrode 70 located adjacent the back of the movable donor belt. An AC voltage is applied to the stationary electrode 70 by AC voltage source 73.

The AC voltage causes high AC fringe fields 78 along the edges of the donor belt electrodes 56 and in the spaces between the electrodes. The high AC electric fields provide an electrostatic detachment force acting on the charged toner 72. For the toner in which the detachment force exceeds the toner adhesion and cohesion, the detached toner collide with neighboring toner to induce toner detachment. As illustrated in FIG. 3, a cascade collisional detachment of toner from the donor belt 32 is obtained as the toner moves through the development zone in gap 34. The combination of high AC fringe fields and the cascade collisional generation thereby produces a toner cloud 74 that enables an efficient non-interactive development system for high speed electrophotographic machines. The utilization of fringe electric fields in a small volume of about 50 $\mu$m in parallel to the field enables the application of high electric fields without the possibility of air breakdown.

The pattern of electrodes 56 on the front surface of the donor belt is held at a common electric potential. Although various geometries of donor belt electrodes 56 are functional, the pattern of parallel electrodes that are parallel to the axes 33A of the donor belt rollers 33 is preferred. The electrical bias of the donor belt electrodes 56 in the development zone in gap 34 is provided through an elongated commutator 75 at one edge of the donor belt as shown in FIG. 4. Since the donor belt 32 is wider than the photoreceptor belt 24, the commutator 75 is adjacent but outside of the development zone defined by the stationary electrode 70. However, the length of the commutator 75 is substantially equal to the length of the stationary electrode 70 and aligned to one side thereof, so that a sufficient number of donor belt electrodes 56 are concurrently biased. The potential of the donor belt electrodes 56 can be set at a DC level by DC voltage source 76 for the purpose of both providing a development electric field in the image areas of the electrostatic latent image and a cleaning electric field in the non-image areas. In the embodiment shown in FIG. 3, both a DC and AC electric bias may be applied to the donor belt electrodes via commutator 75 and DC voltage source 76 and AC voltage source 79. The DC voltage source 76 provides a bias of 200 to 300 volts, and the AC voltage source 79 provides a bias of 500 to 600 volts. The AC amplitude and frequency from voltage source 73 can be set to control the height of the toner cloud 74 for both the optimum development of fine-structure latent images on the photoreceptor and the non-interactive development of an electrostatic latent image in the presence of previously developed image-on-image color images.

The donor belt is preferably seamless and can be fabricated from any suitable dielectric material, such as, for example, polyimide with a typical thickness of 75 to 300 $\mu$m and a charge-relaxable overcoating layer 77 having a thickness of about 25 $\mu$m. Suitable charge-relaxable layer materials are described in U.S. Pat. Nos. 5,300,339 and 5,386,277, the relevant portions of which are incorporated herein by reference. The overcoating layer 77 can be applied by a number of known methods, such as spray or dip coating. The purpose of the charge-relaxable layer is to dissipate any charge accumulation that would cause spurious electric fields on the dielectric donor belt.

If the developer material comprises non-conductive toner and carrier beads with a non-conductive coating, the charge-relaxable overcoating layer is only required in the spaces between the patterned electrodes 56 as shown in FIG. 3. The overcoating layer thickness can either be thin relative to the electrode thickness or the overcoating layer can fill the entire space between electrodes 56 such that the overcoating layer and the electrodes 56 are at the same thickness. Typical dimensions for the patterned electrodes 56 are 100 to 500 μm for both width and spacings and 1 to 35 μm for thickness. On the other hand, a charge-relaxable overcoating layer is also required over the electrodes 56, if the carrier beads of the developer material 50 are conductive. In this latter case (not shown), the charge-relaxable layer on the electrodes 56 has a thickness of 1 to 5 μm over the electrodes 56 and can include of metal oxides that provide better wear resistance. The resistivity of the charge-relaxable layer should be sufficiently high so that the charge-relaxable layer acts like a dielectric for times on the order the AC period of AC voltage source 73. The AC period is typically sub-milliseconds for an AC frequency in the range of 1 to 10 kHz.

For a dielectric donor belt thickness of 100 μm, the peak AC voltage applied to the AC biased electrode 70 is typically in the range of 1,000 to 2,000 volts. The AC voltage provides high fringe fields on the order of 10 to 50 V/μm at the edges of the electrodes 56. High electric fields without the air breakdown limitation are possible since the fields act over a small air gap. For the air gap 34, the distance between the photoreceptor 24 and front surface of the donor belt 32 is about 300 μm, so that the electric fields are limited to only about 5 V/μm across the gap. For the pattern of a parallel electrodes 56 that are parallel to the axes 33A of the donor belt rollers 33, the electrode width, thickness, and spacing from neighboring electrodes effects the toner cloud generation efficiency and interactivity of the toner cloud with the previously developed latent electrostatic image. If the ratio between the electrode width and spacing is too large, the AC electric field acting on the toner on the donor belt will be reduced due to electric shielding. If the ratio is too small, the percentage of the toner on the donor belt subjected to the fringe AC field is reduced, while the interactivity of the toner cloud with the previously developed latent electrostatic image is increased.

The donor belt 32 can be loaded with toner by any number of methods, including single component and two component xerographic developer methods. For single component systems (not shown), a toner metering and charging blade provides and maintains a triboelectric charged toner layer on the donor belt. For two component developer material systems, as used in the preferred embodiment shown in FIG. 2, insulative toner is mixed with either insulative or conductive carrier beads to form the developer material 50. Either soft or hard magnetic carrier beads can be used. The non-magnetic insulative toner can be of any color.

Referring to FIG. 4, the electrically isolated parallel electrodes 56 are also parallel to the donor belt roller axes 33A. Optionally, a DC electrical bias can be applied to the electrodes 56 in regions outside the entrance and exit of the development zone 34 defined by the stationary electrode 70 by commutator brushes and voltage sources (not shown). The bias on the electrodes before and after the development zone can be selected to cause the deposition of any air borne and charged toner onto the donor belt. This provision can help to reduce any undesirable toner emissions from the development zone in gap 34.

Figure 5:
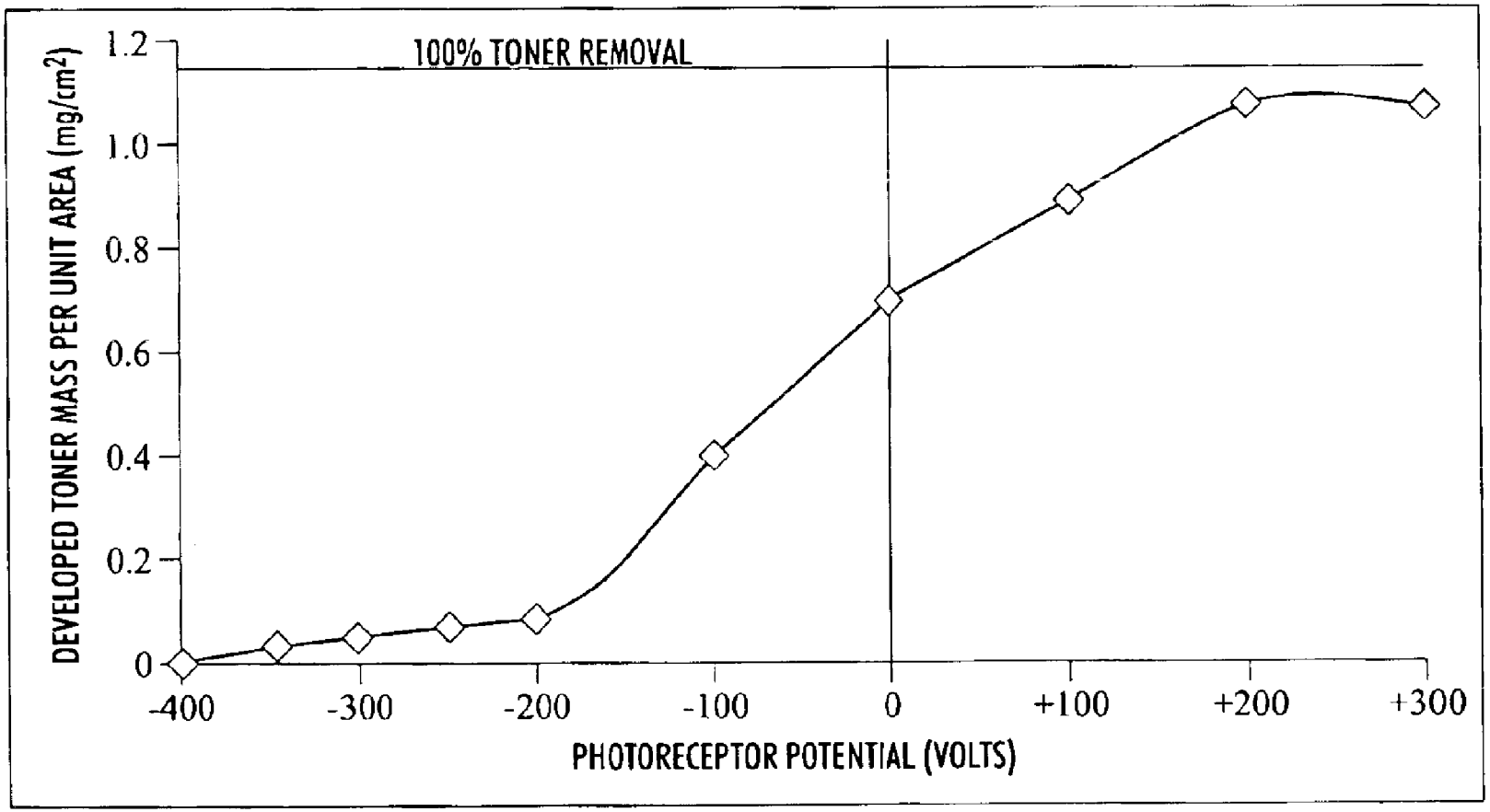
FIG. 5 is a development curve demonstrating the development efficiency of an exemplary embodiment of this application.

A development curve was obtained, as shown in FIG. 5, with one exemplary embodiment of FIG. 3 to demonstrate the high development efficiency of the non-interactive development apparatus of this application. In this example, the seamless donor belt 32 consisted of a 100 μm thick polyimide substrate having parallel copper electrodes 56 patterned on the front surface thereof that are 100 μm wide and spaced 100 μm from each other. The electrodes 56 have a thickness of 17 μm. The electrodes 56 and the spaces therebetween were overcoated with an organic charge relaxable material 77, as described above. A non-magnetic black toner from a conductive two component developer material 50 was loaded onto the donor belt 32 with a toner coverage of 1.15 mg/cm$^2$. The charge-to-mass ratio of the toner was −20.5 μC/gm. The donor belt 32 loaded with toner and the photoreceptor belt 24 were held stationary and parallel to each other with a development gap therebetween of 38 μm. The toner was detached from the electroded donor belt to form a toner cloud by applying 50 cycles of AC voltage to the biasing electrode 70 located in contact with the back surface of the donor belt at a frequency of 3 kHz and a peak amplitude of 1,000 volts. The amount of toner deposited on the photoreceptor was measured as a function of a DC bias on the photoreceptor, while the patterned electrodes 56 were held at ground potential. From FIG. 5, it is seen that most of the toner is removed from the donor belt for a DC bias voltage of 200 volts.

The electroded donor belt 32 is preferably seamless to enable continuous development of a latent electrostatic image. For donor belt tracking (i.e., maintaining the donor belt in the proper location on the donor belt rollers 33), a passive device (not shown) may be used. For example, the passive device could be bands bonded on the inside of the donor belt edges and used to guide the donor belt by well-defined edges on either of the donor belt rollers 33, the one driven or the idle one. Alternatively, a typical active belt-tracking device (not shown) such as edge location sensing and roll steering can be used. Both the passive device and active belt-tracking device are well known in the electrophotographic industry.

Though a stationary AC biased electrode 70 in the back of donor belt 32 is preferred, an AC biased conducting roller (not shown) could be used instead, if only a minimum AC electric field is required to generate a toner cloud for developing the electrostatic latent images. If the donor belt 32 is an insulative dielectric material as preferred, the back of the donor belt tends to triboelectric charge due to the friction with both the stationary dielectric support structure 71 and AC biased electrode 70 thereon and the donor belt rollers 33. Although this charging will occur, it does not have a deleterious effect on the ability to generate a toner cloud 74, since the electric field due to this charging is shunted to the stationary electrode 70 that is in contact with the donor belt.

The non-interactive development apparatus described in this application has a number of advantages over other known non-interactive devices. For one example, there is no problem of wire contamination by toner coating or other additives and debris becoming attached to the wires. In additions the wireless design of this application circumvents developed image defects caused by wire vibration, sometimes referred to as strobing. Another advantage of the non-interactive development apparatus of this application is that it is compatible with wide printing substrates, whereas those development devices that use wires could not prevent the wires from vibrating when wide photoreceptors are used. Another important feature of the development apparatus of this application is that costly high tolerance donor belt rollers 33 are not required, since the development gap or zone is set by the stationary AC biased electrode 70. The ability to increase the width of the development zone by merely increasing the width of the AC biased electrode 70 enables high-speed development and is a large advantage over those development systems that must use wires. The high efficiency of the toner cloud generation, as illustrated by FIG. 5, also contributes to the high-speed development performance.

Figure 6:
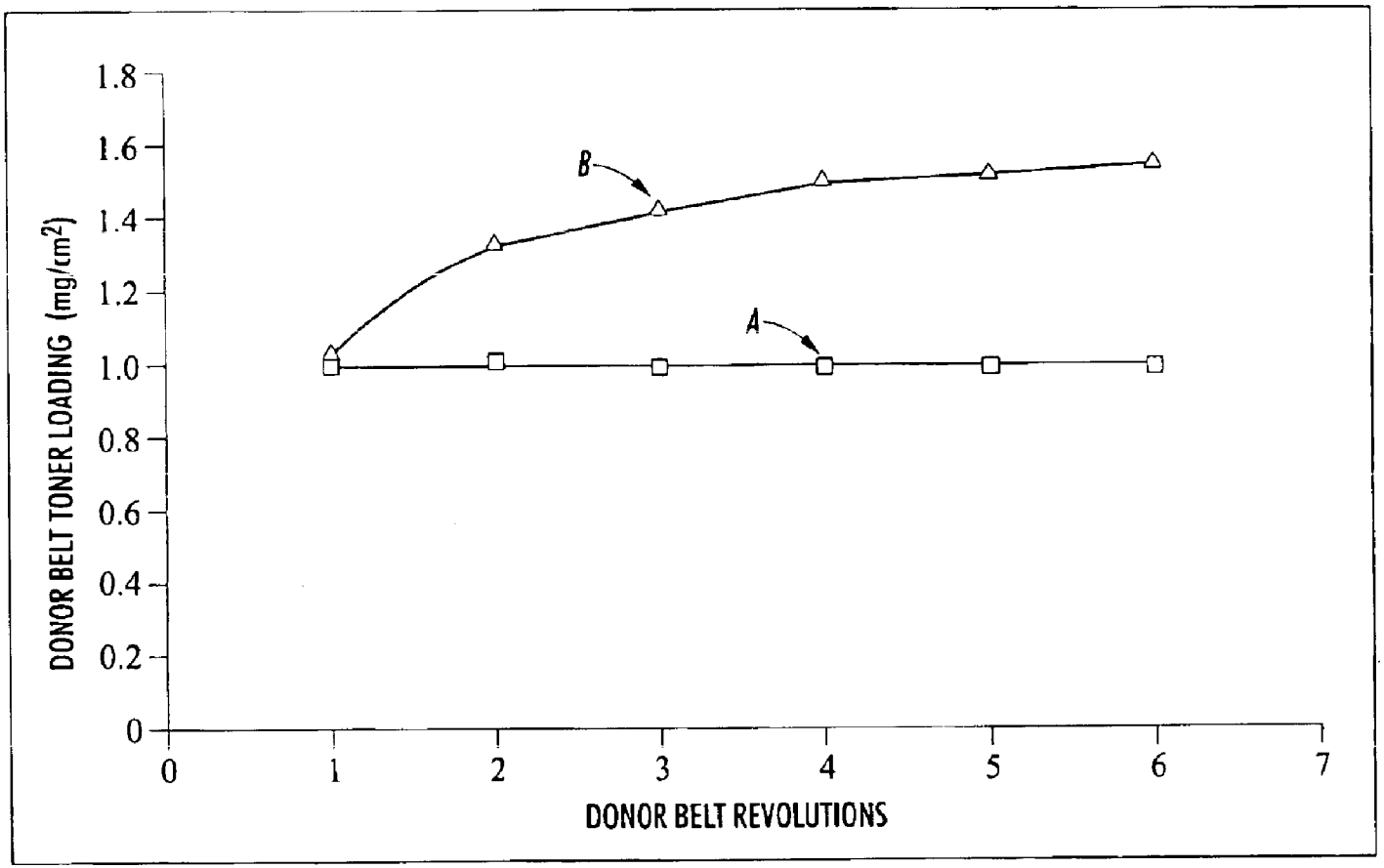
FIG. 6 shows comparison curves for donor belt toner loading as a function of donor belt revolutions for donor belts loaded and unloaded for each revolution versus donor belts loaded but not unloaded.

FIG. 6 shows comparison curves for donor belt toner loading as a function of donor belt revolutions for the example in which the donor belt is loaded and unloaded during each donor belt revolution versus the example in which the donor belt is not unloaded during each donor belt revolution. In curve A, toner is continually unloaded per revolution while in curve B, the toner is not unloaded during each revolution. For these examples, the speeds of the magnetic brush roll 54 and donor belt 32 were 10 inches per second (ips) and −5 ips, respectively (the negative sign indicating opposite travel direction). For unloading toner from the donor belt at the unloading nip 61, a voltage of 600 volts was applied between the patterned electrodes 56 and the magnetic brush roll 54. A voltage of 400 volts was applied between the donor belt roller 33 and the electrodes 56 with a polarity for promoting toner removal from the spaces between the electrodes 56. For loading toner onto the donor belt at the loading nip 51, the voltage between the electrodes 56 and the magnetic brush roll 54 was set at 600 volts and the fringe field bias was zero. Curve A shows that the toner mass per unit area (mg/cm2) remained at about 1 mg/cm2 after several donor belt cycles. Curve B was produced by not unloading toner and demonstrates a reloading efficiency of only 65%. For one revolution of the donor belt, the amount of toner deposited on the donor belt 32 is the same for both of the examples.

The exemplary embodiment described above for continual toner unloading and loading of the electroded donor belt 32 with a single magnetic brush roll 54 using two-component developer material 50 has a number of advantages over the prior art. This embodiment of developer apparatus 20A enables improved toner reloading efficiency of the donor belt. Since the toner is continually removed from the donor belt, history effects caused by toner charge, size, and adhesion changes are avoided. Thus, highly charged toner and smaller toner sizes cannot accumulate on the donor belt.

Although the foregoing description illustrates the preferred embodiment, other variations are possible and all such variations as will be apparent to those skilled in the art are intended to be included within the scope of this application as defined by the following claims.

What is claimed is:

1. A non-interactive development apparatus for use in a multicolor electrophotographic machine having a moving photoreceptor belt therein, the development apparatus being capable of developing a portion of a multicolor electrostatic latent image on a surface of said photoreceptor belt with toner without disturbance or contamination of previously developed portions of the electrostatic latent image, said development apparatus comprising:

a housing defining a chamber storing a supply of developer material comprised of carrier beads and toner;

a movable dielectric donor belt having a front and back surface with an electrode pattern being formed on said belt front surface, said belt being adjacent but spaced from the photoreceptor belt surface for conveying toner on said donor belt front surface to a development zone located in a space between said donor belt and photoreceptor belt surface;

means for supporting said donor belt for movement in an endless-path past the development zone;

means for advancing developer material from the housing chamber, said advancing means and said donor belt cooperating with one another to deposit a substantially constant quantity of toner having a substantially constant triboelectric charge onto said donor belt front surface for transporting said toner through said development zone;

a stationary electrode positioned behind and in contact with the back surface of a span of said donor belt, said stationary electrode having a dimension and location to define said development zone; and an AC voltage supply connected to the stationary electrode to provide an AC bias thereto, The AC voltage producing AC fringe fields at the edges of the electrode pattern on said front surface of the donor belt as said donor belt is conveyed past the stationary electrode, whereby said AC fringe fields cause detachment of the toner from the donor belt front surface and generation of a toner cloud in the development zone that develops the electrostatic latent image on the photoreceptor belt surface.

2. The development apparatus as claimed in claim 1, wherein said means for supporting said donor belt is a pair of donor belt rollers, said donor belt rollers each having an axis parallel with each other and about which said donor belt rollers are rotated; and wherein said electrode pattern on said front surface of the donor belt is an array of equally spaced, electrically isolated, elongated electrodes that are parallel to each other and the donor belt roller axes.

3. The development apparatus as claimed in claim 2, wherein said means for advancing developer material from the housing chamber is a rotatably driven magnetic brush roll that advances a uniform layer of developer material to said donor belt; and wherein said donor belt is wider than both that magnetic brush roll and the photoreceptor belt.

4. The development apparatus as claimed in claim 3, wherein the development apparatus further comprises:

a first commutator connected to a DC voltage source, the first commutator being positioned on the outer edge of the donor belt front surface and at a location adjacent but outside of said development zone, said first commutator having a length substantially equal to the length of the stationary electrode and being aligned therewith in order to bias concurrently the elongated electrodes on the donor belt front surface that are in said development zone.

5. The development apparatus as claimed in claim 4, wherein said first commutator is also biased by an AC voltage source.

6. The development apparatus as claimed in claim 4, wherein a span of said donor belt between said pair of donor belt rollers is partially wrapped around the magnetic brush roll, so that a layer of developer material is sandwiched therebetween; and wherein the direction of rotation of the magnetic brush roll is opposite to the direction of rotation of the donor belt, thus forming an entrance nip and an exit nip for said developer material on said magnetic brush roll.

7. The developer apparatus as claimed in claim 6, wherein the developer apparatus further comprises:

a second commutator connected to a second DC voltage source being positioned on an outer edge of the donor belt front surface adjacent the magnetic brush roll and at said entrance nip, said second commutator electrically biasing a number of the donor belt electrodes at said entrance nip, in order to effect extraction of toner from the developer material on the magnetic brush roll and to load the toner onto said donor belt front surface; and a third commutator connected to a third DC voltage source being positioned on an outer edge of the donor belt front surface adjacent the magnetic brush roll and at said exit nip, said third commutator electrically biasing a number of the donor belt electrodes, in order to effect removal of said toner from the donor belt and onto the magnetic brush roll after the toner has passed through the development zone, so that toner is continually loaded and unloaded from the donor belt front surface.

8. The development apparatus as claimed in claim 7, wherein the development apparatus further comprises:

a charge-relaxable overcoating layer on the front surface of the donor belt to dissipate any charge accumulation that would cause spurious electric fields.

9. The development apparatus as claimed in claim 8, wherein said developer material comprises a non-conductive toner and a carrier with a non-conductive coating; and wherein said charge-relaxable layer on the donor belt front surface is only between the donor belt electrodes.

10. The development apparatus as claimed in claim 8, wherein said developer material comprises a carrier that is conductive; and wherein said charge-relaxable layer on the donor belt front surface covers the donor belt electrodes as well as the spaces therebetween.

11. A non-interactive development system for a multicolor electrophotographic machine having a moving photoreceptor belt therein, the development system having a plurality of non-interactive development apparatus disposed seriatim adjacent the photoreceptor belt, one non-interactive developer apparatus being provided for each color to be used in developing a multicolor color electrostatic latent image, and each development apparatus being capable of developing a portion of the latent image on a surface of the photoreceptor surface with toner without disturbance or contamination of previously developed portions of the latent image, wherein each development apparatus of said development system comprises:

a housing defining a chamber storing a supply of developer material comprised of carrier beads and toner;

a movable dielectric donor belt having a front and back surface with an electrode pattern being formed on said belt front surface, said belt being adjacent but spaced from the photoreceptor belt surface for conveying toner on said donor belt front surface to a development zone located in a space between said donor belt and photoreceptor belt surface;

means for supporting said donor belt for movement in an endless path past the development zone;

means for advancing developer material from the housing chamber, said advancing means and said donor belt cooperating with one another to deposit a substantially constant quantity of toner having a substantially constant triboelectric charge onto said donor belt front surface for transporting said toner through said development zone;

a stationary electrode positioned behind and in contact with the back surface of a span of said donor belt, said stationary electrode having a dimension and location to define said development zone; and an AC voltage supply connected to the stationary electrode to provide an AC bias thereto, The AC voltage producing AC fringe fields at the edges of the electrode pattern on said front surface of the donor belt as said donor belt is conveyed past the stationary electrode, whereby said AC fringe fields cause detachment of the toner from the donor belt front surface and generation of a toner cloud in the development zone that develops the electrostatic latent image on the photoreceptor belt surface.

* * * * *